United States Patent [19]

Schröter

[11] 4,092,658

[45] May 30, 1978

[54] PHOTOPRINTING MACHINE WITH A DEVICE FOR EXPELLING EXCESS AMMONIA-CONTAINING DEVELOPER MEDIUM FROM DEVELOPED DIAZOTYPE PAPER

[75] Inventor: Herbert Schröter, Taunusstein, Germany

[73] Assignee: Hoechst Aktiengesellschaft, Germany

[21] Appl. No.: 689,960

[22] Filed: May 25, 1976

[30] Foreign Application Priority Data

May 26, 1975 Germany ..... 2523228

[51] Int. Cl.[2] ..... G03D 7/00

[52] U.S. Cl. ..... 354/300; 55/102; 219/216; 250/319

[58] Field of Search ..... 55/6, 102, 124; 250/316, 317, 318, 319; 354/300; 219/216

[56] References Cited

U.S. PATENT DOCUMENTS

| | | | |
|---|---|---|---|
| 1,817,198 | 8/1931 | Langsner | 354/300 X |
| 2,058,983 | 10/1936 | Horn | 354/300 X |
| 3,230,857 | 1/1966 | Ritzerfeld et al. | 355/106 |
| 3,745,307 | 7/1973 | Peek et al. | 219/216 X |

*Primary Examiner*—Fred L. Braun
*Attorney, Agent, or Firm*—James E. Bryan

[57] ABSTRACT

In a photoprinting machine including a developing chamber in which a web of exposed diazotype paper continuously fed at an adjustable speed is developed with a developer medium composed of a vaporous ammonia/water mixture, an after-treating chamber following next in the direction of feed of the diazotype paper and which is connected with a device for removing ammonia-containing exhaust air, and a device for expelling developer medium from the developed diazotype paper. The expelling device includes a high energy infrared radiator positioned opposite the web in the after-treating chamber, a connection between the high-energy infrared radiator and an output of a heat output control device, and an input for the heat control device connected to a transmitter of the feed speed. The heat output control device having a characteristic such that the heat output of the high-energy infrared radiator is proportional to the feed speed and the color temperature of the high-energy infrared radiator is about 2000° K at the maximum feed speed of the diazotype paper.

3 Claims, 1 Drawing Figure

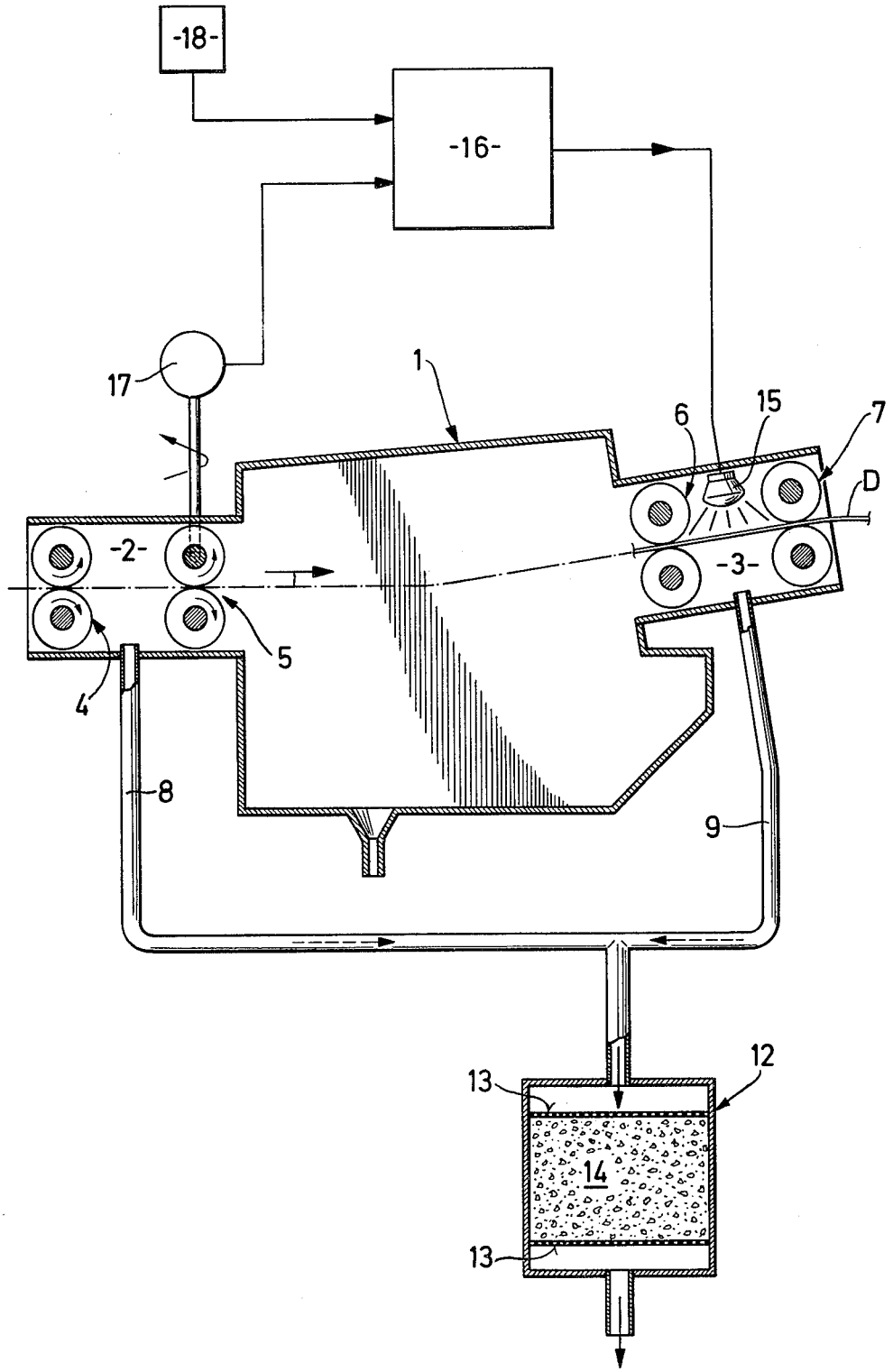
-18-
-16-
17
1
6
15
7
D
-2-
-3-
5
4
8
9
12
13
14
13

PHOTOPRINTING MACHINE WITH A DEVICE FOR EXPELLING EXCESS AMMONIA-CONTAINING DEVELOPER MEDIUM FROM DEVELOPED DIAZOTYPE PAPER

The present invention relates to a photoprinting machine comprising a developing chamber in which exposed diazotype paper continuously fed at an adjustable speed is developed with a developer medium composed of a vaporous ammonia/water mixture, an after-treating chamber which follows next in the direction of feed and which is connected with a device for removing ammonia-containing exhaust air, and a device for expelling developer medium from the developed diazotype paper by the application of heat.

When using photoprinting machines, the problem occurs that the ammonia contained in the developer medium should be eliminated as completely as possible from the waste water, the exhaust air, and the developed diazotype material in order to avoid environmental pollution. It is known that waste water containing ammonia can be collected. Exhaust air may be cleaned by conducting it over an oxidation catalyst which, if a temperature within a special range is maintained, burns the ammonia to produce nitrogen and water. So that this process may proceed without supplying energy from without, the gas mixture supplied to the catalyzer vessel must have a certain concentration of ammonia (German Offenlegungsschrift No. 2,319,934).

It is known from the prior art (German Offenlegungsschrift No. 2,227,588) to remove excess developer medium from developed diazotype papers (photoprints) in that, in a device for sorting and stacking sheets which preferably may be combimed with a photoprinting machine, an air jet is directed upon the surface of the photoprints which jet entrains a considerable portion of the ammonia adhering to the photoprints. The quantities of air passed through the machine in this manner, which have a relatively low ammonia concentration once they have left the surface of the photoprint, are not adapted, per se, to maintain the catalytic combustion process without the application of heat.

In an apparatus for making duplicates from microfilms which is known by the trade name "Ozakop", the developed diazotype material is passed through a heating chamber heated by a heating plate. The temperature of the metallic heating plate is so low that, in any case, no radiation within the visible range of the spectrum is emitted. In order to prevent ammonia-laden exhaust air from escaping from the heating chamber and from the adjacent room, in which the developed diazotype material is stacked, into the immediate surroundings of the machine, these rooms are connected with a suction device by which the exhaust air is passed into the open. It is not advisable, however, to conduct the exhaust to a catalyst for the catalytic combustion of ammonia, because the ammonia content of the air drawn from the heating chamber is not high enough for this purpose. The diazotype material used for the manufacture of microfilmm duplicates, i.e. polyester films or acetate films, has a low moisture absorption capacity, so that ammonia-containing water can substantially deposit only on the surface of the diazotype material. Therefore, satisfactory results are not obtained by applying the use of a heating plate adequate for the removal of ammonia superficially adhering to the above-mentioned diazotype films, to photoprinting machines in which highly absorptive diazotype papers (photoprinting papers) are processed.

A further difficulty in the removal of developer medium from developed diazotype papers in photprinting machines is due to the fact that the feed speed of the diazotype paper through the photoprinting machine may be varied within a wide range, for example from 0.5 to 15 meters per minute. This involves the risk that a heating capacity which is sufficient for a certain feed speed will not be adequate for evaporating the developer medium at a higher speed, but will lead to overheating of the diazotype paper and possibly undersirable discolorations at lower speeds.

It is the object of the present invention to provide a photoprinting machine of the above-described type comprising a device for expelling excess developer medium from the developed diazotype paper which is capable of virtually completely removing, at varying feed speeds, the developer medium retained, especially absorbed, by the diazotype paper after development, without the occurrence at any speed of influences which may impair the quality of the photoprints produced. The removal of the expelled developer medium should offer as little difficulty as possible and the device should be inexpensive.

In the case of a photoprinting machine of the above-described type, this object is achieved in that, in the after-treating chamber, an infrared radiator emitting within the short-wave, high-energy infrared range is arranged opposite the web of diazotype paper; the high-energy infrared radiator is connected to the output of a heat output control system the input of which is connected to a transmitter of the feed speed; and the transfer characteristic of the heat output control system is such that the heat output emitted by the high-energy infrared radiator is proportional to the feed speed.

When using this device, the developer medium may be almost completely expelled from the diazotype paper by heat action at any adjustable feed speed. Since the heat output emitted by the high-energy infrared radiator is maintained proportional to the feed speed, the virtually complete removal of the developer medium, including the water component, can be successfully performed even at high speeds of the exposed and developed diazotype paper, for example at a feed speed of 15 meters per minute. On the other hand, as a result of the adaptation of the heat output to the feed speed, over-heating of the diazotype paper is reliably avoided, even at feed speeds as low as 0.5 meter per minute. Thus, the quality of the image reproduced is fully maintained and no undesirable discoloration of the photoprint occurs. Due to the low thermal inertia of the high-energy infrared radiator, the inventive device for expelling developer medium has the essential advantage that an optimal heat output is also applied to the leading end of a web of diazotype paper. Before the leading end of the web reaches the zone of the high-energy infrared radiator in the after-treating chamber, the transmitter of the feed speed has sent a signal to the heat output control system which corresponds to the then feed speed of the web of diazotype paper. Since the high-energy infrared radiator responds to the output signal of the heat output control system after only a very short delay, it is guaranteed that even the leading end of a web of diazotype paper is treated with just the right amount of irradiated heat.

As an essential feature, there is virtually no delay in the transfer of heat from the heat source to the diazotype paper, because the energy is transferred by radiation and not by conduction (heat conduction) and convection (heat conduction through a medium).

Because the developer medium is expelled by optimizing the heat action upon the photoprinting paper, no large throughput of air is necessary. All that is required is a suction device such as those conventionally provided in connection with the developing chamber and after-treating chamber of photoprinting apparatuses. Since the relatively small quantity of exhaust air drawn-off has a relatively high ammonia concentration, the reduction of the ammonia content requires no expensive apparatus. Thus, the absolute quantity of ammonia released into the surroundings can be maintained low.

According to a particularly advantageous embodiment of the invention, the device for expelling excess developer medium has the additional feature that the working point on the characteristic curve of the heat output control system is so adjusted, by means of an adjusting element, that the color temperature of the high-energy infrared radiator is at about 2000° K (degrees Kelvin) at the maximum feed speed of the diazotype paper. A high-energy infrared radiator of this type reacts particularly rapidly on changes in the feed speed, because its start-up time is only 0.1 second.

The high-energy infrared radiator is essentially composed of a quartz tube in which a heating coil is arranged. The interior of the quartz tube is evacuated and then filled with a protective gas in order to enable the heating coil to withstand higher stress without volatilizing.

In order to reliably determine the feed speed on which the irradiated heat output is made dependent, a tacho-alternator connected to at least one feed roller conveying the web of diazotype paper is used as the transmitter of the feed speed.

In order to eliminate the developer medium expelled from the diazotype paper, the device preferably also comprises a suction device and an oxidizing catalyst over which the exhaust air is passed in order to burn the ammonia component.

This embodiment is of particular advantage because the developer medium drawn-off from the after-treating chamber has a relatively high ammonia concentration due to developer medium flowing in an undesirable manner from the developing chamber to the after-treating chamber, so that the catalytic combustion may be maintained without supplying additional heat. Thus, the ammonia expelled from the web of diazotype paper is also burned.

The invention will now be further described by reference to the accompanying drawing in which the parts of the photoprinting apparatus which are of importance in connection with the invention are diagrammatically shown, complete with a device for expelling developer medium from the developed diazotype paper.

In detail, the component parts of the photoprinting machine, i.e. a developing chamber, a device for removing ammonia-containing exhaust air, and a device for expelling developer medium, are shown in longitudinal section in the drawing, whereas the electrical arrangements connected therewith are represented as a block diagram.

The drawing shows a developing chamber 1 with an ante-chamber 2 and an after-treating chamber 3. The antechamber is sealed from the outside by a pair of rollers 4 and from the developing chamber by a pair of rollers 5. Analogously, roller pairs 6 and 7 serve to seal the after-treating chamber 3. The antechamber and after-treating chamber are connected to a catalyzer vessel 12 by the suction pipes 8 and 9. The catalyzer vessel 12 contains sieves 13 which confine the catalyst 14.

For the sake of clarity, the means for supplying liquid developer solution to the developing chamber and the means provided in the developing chamber for evaporating ammonia and water, to produce the desired vaporous developer medium, are omitted from the drawing. Further, the diazotype paper web D is shown only in the vicinity of the pairs of rollers 6 and 7 of the drawing. The web passes from the pairs of rollers 4 and 5, through the developing chamber to the pairs of rollers 6 and 7, and leaves the after-treating chamber 3 through the gap between the pair of rollers 7.

Special means for controlling the temperature of the catalyst, which may be connected with the catalyzer vessel, the sieves and the catalyst and which serve to maintain the temperature constant in spite of fluctuations in the temperature of the exhaust air flowing in through the pipes 8 and 9, are also omitted from the drawing.

The electrical equipment comprises a high-energy radiator 15 which is arranged in the after-treating chamber in such a manner that it irradiates the web of diazotype paper D. The high-energy infrared radiator is connected to the output of the heat output control system 16. The input of the heat output control system 16 is connected to a tacho-alternator 17 which is connected with one roller of the pair of driven rollers 5. A second input of the heat output control system 16 is connected with a manually adjustable adjusting element 18, by means of which the working point on the characteristic curve of the heat output control system may be adjusted.

During operation of the photoprinting apparatus, an ammonia/water vapor atmosphere prevails in the developing chamber 1, which has a temperature and ammonia concentration desirable for the developing process. The catalyst 14 is heated to a temperature at which the ammonia component of the exhaust air supplied by the suction pipes 8 and 9 is substantially eliminated without causing the formation of any substantial quantities of undesirable nitric oxides.

The feed speed at which the pairs of rollers 4, 5, 6, and 7 convey the diazotype paper through the antechamber and the after-treating chamber, is adapted to the speed at which the web of diazotype material passes through the exposure station of the photoprinting machine (not shown in the drawing). The feed speed through the exposure station may depend on the transparency of the originals used.

In order to expel excess developer medium from the web of diazotype paper before it leaves the after-treating chamber, the diazotype paper is irradiated in the after-treating chamber with the high-energy infrared radiator 15. In this manner, the humidity absorbed by the diazotype paper is evaporated and simultaneously the volume of the gas contained in the diazotype paper is increased. The radiation output with which the high-energy infrared radiator irradiates the diazotype paper is determined by the signals fed to the heat output control system by the tacho-alternator 17 and the adjusting element 18. The adjusting element is so adjusted that at a maximum feed speed of the diazotype paper the color temperature of the infrared radiator is about 2000° K. The feed speed may vary, for example, from 0.5 to 15 meters per minute. At a relatively low feed speed, the tacho-alternator 17 produces a correspondingly low voltage, so that the electrical energy fed by the heat output control system to the high-energy infrared radiator 15 is correspondingly low. In this manner, care is taken that the energy absorbed by any one section of the diazotype paper remains substantially constant in spite of a low feed speed. At the same time, the maximum of the radiation emitted by the high-energy infrared radiator is displaced to a lower color temperature. Vice versa, the higher energy produced by the tacho-alternator 17 at a higher feed speed causes the high-energy infrared radiator 15, through the heat output control system 16, to increase its output. In this manner, the high-energy infrared radiator 15 irradiates the diazotype paper more intensively, and the diazotype paper absorbs practically the same radiation energy although its feed speed is higher.

The developer medium expelled from the diazotype paper in the manner described leaves the after-treating chamber 3 together with the exhaust air and is conveyed to the catalyzer vessel 12 where the ammonia is substantially completely eliminated by combustion.

It will be obvious to those skilled in the art that many modifications may be made within the scope of the present invention without departing from the spirit thereof, and the invention includes all such modifications.

What is claimed is:

1. In a photoprinting machine comprising a developing chamber in which a web of exposed diazotype paper continuously fed at an adjustable speed is developed with a developer medium composed of a vaporous ammonia/water mixture, an after-treating chamber following next in the direction of feed of the diazotype paper and which is connected with a device for removing ammonia-containing exhaust air, and a device for expelling developer medium from the developed diazotype paper, the improvement comprising a high-energy infrared radiator positioned opposite the web in the after-treating chamber, means electrically connecting said high-energy infrared radiator to an output of an electrical heat output control device, an input of which control device is connected to a transmitter of the feed speed, the heat output control device having a characteristic such that the heat output of the high-energy infrared radiator is proportional to the feed speed, and the color temperature of the high-energy infrared radiator is about 2000° K at the maximum feed speed of the diazotype paper.

2. A photoprinting machine according to claim 1 including, as the transmitter of the feed speed, a tacho-alternator connected to at least one feed roller for the web.

3. A photoprinting machine according to claim 1 in which the device for removing ammonia-containing exhaust air includes at least one exhaust pipe and an oxidation catalyst over which the exhaust air is conducted for combustion of the ammonia.

* * * * *